US005586859A

United States Patent [19]

Nolcheff

[11] Patent Number: 5,586,859

[45] Date of Patent: Dec. 24, 1996

[54] FLOW ALIGNED PLENUM ENDWALL TREATMENT FOR COMPRESSOR BLADES

[75] Inventor: Nick A. Nolcheff, Palm Beach Gardens, Fla.

[73] Assignee: United Technologies Corporation, Hartford, Conn.

[21] Appl. No.: 455,580

[22] Filed: May 31, 1995

[51] Int. Cl.[6] ..... F01D 1/12

[52] U.S. Cl. ..... 415/58.5; 415/57.4; 415/58.7; 415/173.1; 415/173.4; 415/914

[58] Field of Search ..... 415/54.1, 58.5, 415/58.7, 57.3, 57.4, 115, 144, 145, 173.1, 173.4, 173.6, 914

[56] References Cited

U.S. PATENT DOCUMENTS

| | | | |
|---|---|---|---|
| 3,365,124 | 1/1968 | Burge et al. | 415/115 |
| 4,551,064 | 11/1985 | Pask | 415/115 |
| 4,784,569 | 11/1988 | Sidenstick et al. | 415/173.1 |
| 5,161,944 | 11/1992 | Wood | 415/173.1 |
| 5,308,225 | 5/1994 | Koff et al. | 415/58.7 |

FOREIGN PATENT DOCUMENTS

| | | | |
|---|---|---|---|
| 0183204 | 7/1988 | Japan | 415/914 |

*Primary Examiner*—Edward K. Look
*Assistant Examiner*—Christopher Verdier
*Attorney, Agent, or Firm*—Christopher T. Hayes

[57] ABSTRACT

A tip shroud assembly comprising a segmented annular shroud, each segment comprising a radially outer surface, and a radially inner surface including a plurality of first holes defining a first row and a plurality of second holes defining a second row, with each of the rows extending circumferentially along the length of the segment and the first row in spaced relation to the second row. Spaced radially outward from the radially inner surface is a circumferentially extending plenum, and a plurality of first passages extend from one of the first holes to the plenum, and a plurality of second passages extend from one of the second holes to said plenum. The plenum communicates with the radially inner surface through each of the first and second passages, and the length of each of the first passages is at least three times the diameter of the first hole from which it extends.

4 Claims, 4 Drawing Sheets

FLOW ALIGNED PLENUM ENDWALL TREATMENT FOR COMPRESSOR BLADES

DESCRIPTION

1. Technical Field

This invention relates to tip shroud assemblies of axial flow gas turbine engine compressors, and specifically to such shrouds which recirculate air at the tips of airfoil in the compressor to reduce the likelihood of compressor stall.

2. Background Art

In an axial flow gas turbine engine, such as the type used on aircraft, air is compressed in a compressor section, mixed with fuel combusted in a combustor section, and expanded through a turbine section that, via one or more shafts, drives the compressor section. The overall efficiency of such engines is a function of, among other factors, the efficiency with which the compressor section compresses the air. The compressor section typically includes a low pressure compressor driven by a shaft connected to a low pressure turbine in the turbine section, and a high pressure compressor driven by a shaft connected to a high pressure turbine in the turbine section. The high and low compressors each include several stages of compressor blades rotating about the longitudinal axis 100 of the engine, as shown in FIG. 1. Each blade 10 has an airfoil 12 that extends from a blade platform 14 and terminates in a blade tip 16, and the blade tips 16 rotate in close proximity to an outer air seal 18, or "tip shroud". The tip shroud 18 extends circumferentially about the blade tips 16 of a given stage, and the blade platforms 14 and the tip shroud 18 define the radially inner and outer boundaries, respectively, of the airflow gaspath through the compressor.

The stages are arranged in series, and as air is pumped through each stage, the air experiences an incremental increase in pressure. The total pressure increase through the compressor is the sum of the incremental pressure increases through each stage, adjusted for any flow losses.: Thus, in order to maximize the efficiency of a gas turbine engine, it would be desirable, at a given fuel flow, to maximize the pressure rise (hereinafter referred to as "pressure ratio") across each stage of the compressor.

Unfortunately, one of the problems facing designers of axial flow gas turbine engines is a condition known as compressor stall. Compressor stall is a condition in which the flow of air through a portion of a compressor stage ceases, because the energy imparted to the air by the blades of the compressor stage is insufficient to overcome the pressure ratio across the compressor stage. If no corrective action is taken, the compressor stall may propagate through the compressor stage, starving the combustor of sufficient air to maintain engine speed. Under some circumstances, the flow of air through the compressor may actually reverse direction, in what is known as a compressor surge. Compressor stalls and surges on aircraft powerplants are engine anomalies which, if uncorrected, can result in loss of the aircraft and everyone aboard.

Compressor stalls in the high compressor are of great concern to engine designers, and while compressor stalls can initiate at several locations within a given stage of a compressor, it is common for compressor stalls to propagate from the blade tips where vortices occur. It is believed that the axial momentum of the airflow at the blade tips tends to be lower than at other locations along the airfoil. From the foregoing discussion it should be apparent that such lower momentum could be expected to trigger a compressor stall.

As an aircraft gas turbine engine accumulates operating hours, the blade tips tend to wear away the tip shroud, increasing the clearance between the blade tips and the tip shroud. As those skilled in the art will readily appreciate, as the clearance between the blade tip and the tip shroud increases, the vortices become greater, resulting in a larger percentage of the airflow having the lower axial momentum discussed above. Accordingly, engine designers have sought to remedy the problem of reduced axial momentum at the blade tips of high compressors.

An effective device for treating tip shrouds to desensitize the high pressure compressor of an engine to excessive clearances between the blade tips and tip shrouds is shown and described in U.S. Pat. No. 5,282,718 issued Feb. 4, 1994, to Koff et al, which is hereby incorporated by reference herein. In practice, the tip shroud assembly disclosed in U.S. Pat. No. 5,282,718, is composed of an inner ring 20 and outer ring 22 as shown in FIG. 2. In the high pressure compressor application, the rings 20, 22 are initially forged, and hundreds of small, complicated vanes 24 are machined onto one of the rings 20, 22 to direct airflow and minimize efficiency penalties. The inner ring 20 and outer ring 22 are then segmented, and the inner ring 20 is attached to the outer ring 22 by use of attachments 26 such as bolts, rivets, welding or a combination thereof. Unfortunately, experience has shown that although effective, the tip shroud assembly of the prior art is costly due to the large amount of time required to machine the vanes 24.

What is needed is a tip shroud assembly which provides some of the benefits against stall of the prior art with comparable efficiency penalties yet provides a significant reduction in manufacturing cost as compared to the prior art.

SUMMARY OF THE INVENTION

It is therefore an object of the present invention to provide a tip shroud assembly which provides benefits of the prior art tip shrouds yet provides a significant reduction in manufacturing cost, while increasing the maintainability and safety as compared to the prior art.

According to the present invention, a tip shroud assembly is disclosed comprising a segmented annular shroud, each segment comprising a radially outer surface, and a radially inner surface including a plurality of first holes defining a first row and a plurality of second holes defining a second row, with each of the rows extending circumferentially along the length of the segment and the first row in spaced relation to the second row. Spaced radially outward from the radially inner surface is a circumferentially extending plenum, and a plurality of first passages extend from one of the first holes to the plenum, and a plurality of second passages extend from one of the second holes to said plenum. The plenum communicates with the radially inner surface through each of the first and second passages, and the length of each of the first passages is at least three times the diameter of the first hole from which it extends.

The foregoing and other features and advantages of the present invention will become more apparent from the following description and accompanying drawings.

BEST MODE FOR CARRYING OUT THE INVENTION

Figure 1:
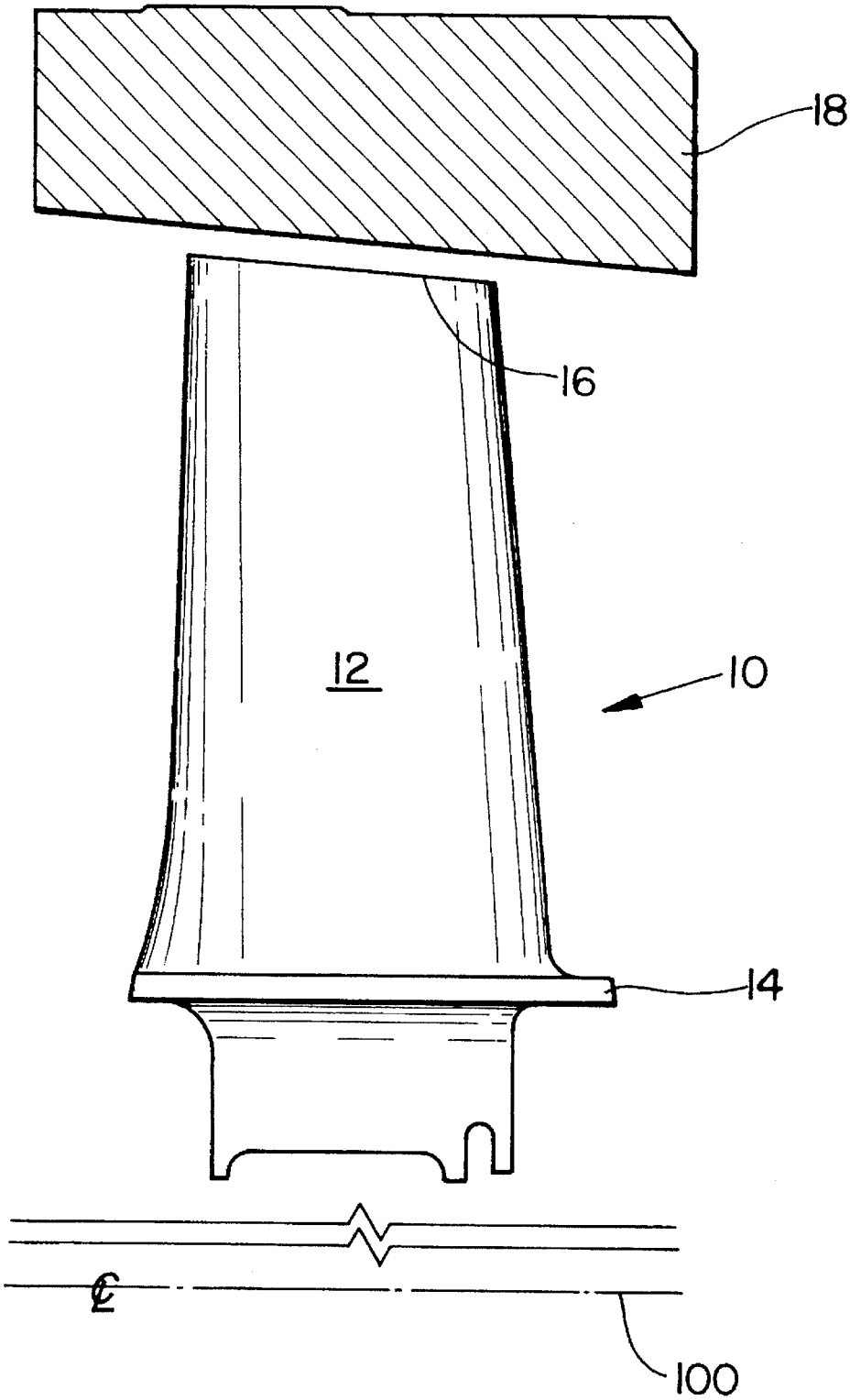
FIG. 1 (PRIOR ART)
FIG. 1 is view of a compressor blade and tip shroud of the prior art.
Figure 2:
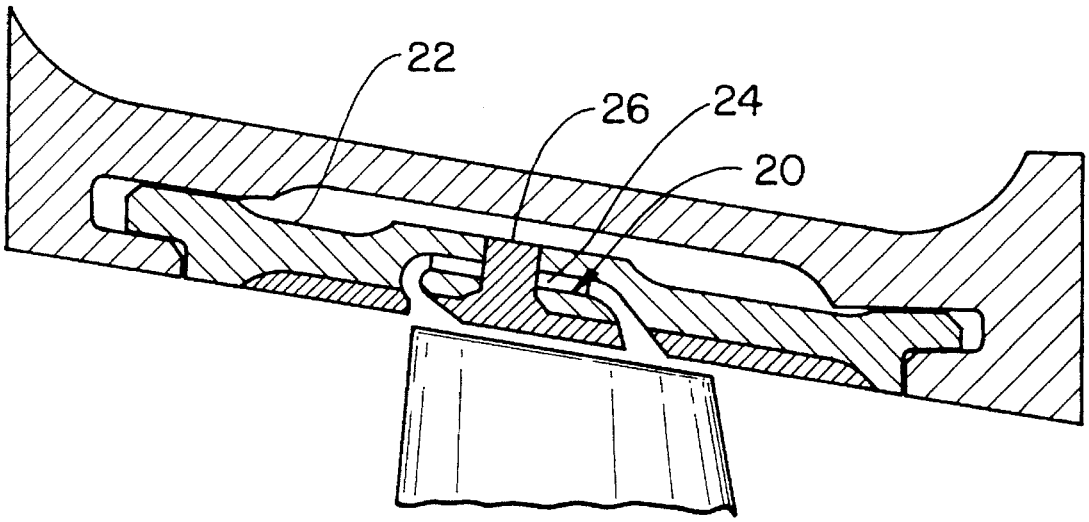
FIG. 2 (PRIOR ART)
FIG. 2 is a cross sectional view of a tip shroud of the type disclosed in U.S. Pat. No. 5,282,718.
Figure 3:
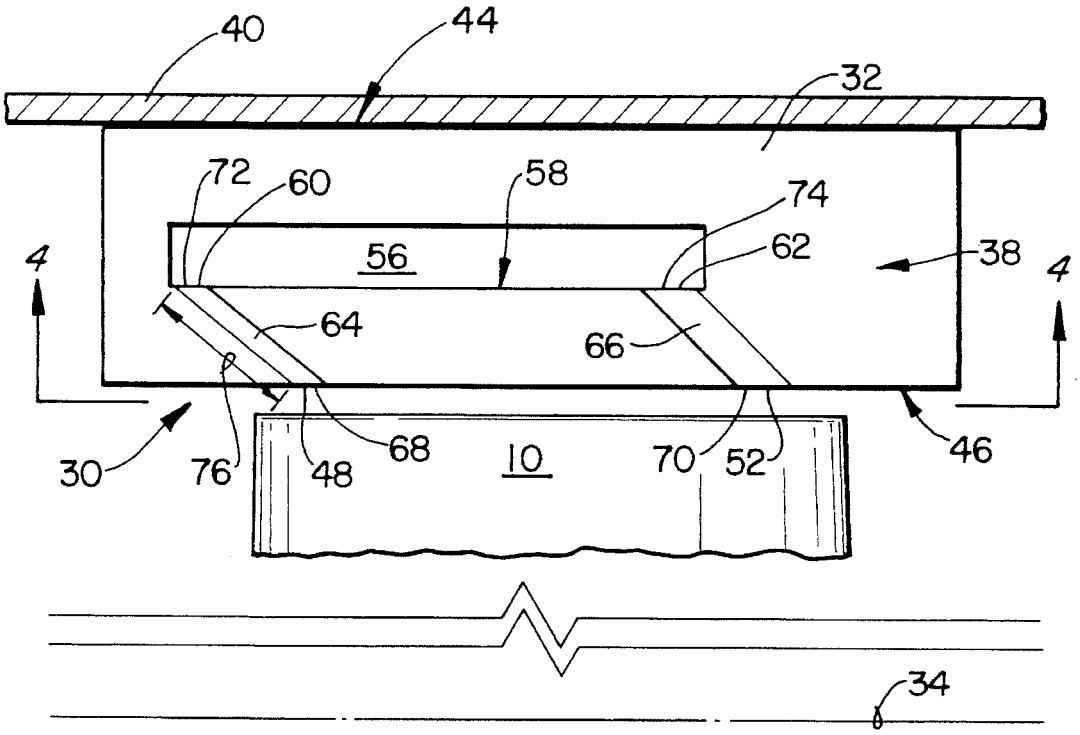
FIG. 3 is a cross sectional view of the preferred embodiment of the tip shroud of the present invention.
Figure 4:
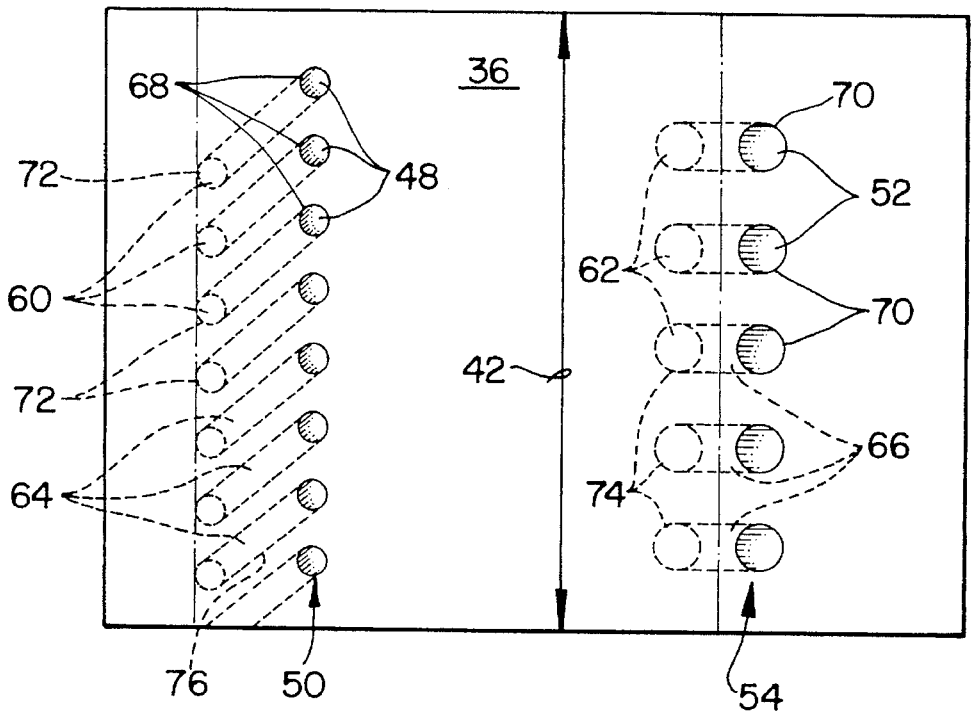
FIG. 4 is a plan view of the radially inner surface of the preferred embodiment taken along line 4—4 of FIG. 3 showing passages which are circular in cross section.

As shown in FIG. 3, the tip shroud assembly 30 of the present invention comprises an annular shroud 32 extending circumferentially about a reference axis 34 which, once the assembly 30 is placed into an engine, defines the longitudinal axis 100 of the engine. The annular shroud 32 is comprised of a plurality of arcuate shroud segments 36, a portion of one of which is shown in FIG. 4. Referring back to FIG. 3, each segment 36 of the annular shroud 32 is secured to the engine case 40 in the manner known in the art, and each segment 36 has a length 42, and the sum of the lengths 42 of the segments 36 defines the circumference of the annular shroud 32. Each segment 36 comprises an arcuate member 38 having a radially outer surface 44, and a radially inner surface 46 including a plurality of first holes 48 defining a first row 50 as shown in FIG. 4, and a plurality of second holes 52 defining a second row 54. Each of the rows 50, 54 extends circumferentially along the length 42 of the segment 36, and the first row 50 is spaced axially from the second row 54 relative to the reference axis 34.

Each segment 36 also includes a circumferentially extending plenum 56 spaced radially outward from the radially inner surface 46, and the radially innermost boundary of the plenum 56 defines the plenum surface 58 which is likewise located radially outward of the radially inner surface 46. The plenum surface 58 includes a plurality of third holes 60 and a plurality of fourth holes 62. Each segment 36 likewise includes a plurality of first passages 64 and second passages 66 extending between the plenum surface 58 and the radially inner surface 46, and each passage has a first end 68, 70 and a second end 72, 74. Each of the first holes 48 defines the first end 68 of one of the first passages 64, and one of the third holes 60 in the plenum surface 58 defines the second end 72 thereof. Likewise, each of the second holes 52 defines the first end 70 of one of the second passages 66, and one of the fourth holes 62 in the plenum surface 58 defines the second end 74 thereof. Thus, each first passage 64 extends from one of the first holes 48 to the plenum 56 and each of the second passages 66 extends from one of the second holes 52 to the plenum 56, so that the plenum 56 communicates with the radially inner surface 46 through each of the first and second passages 64, 66. The diameters of the first and third holes 48, 60 is the same, and the length 76 of each of the first passages 64 must be at least three (3) times the diameter of the first hole 48 that defines the first end 68 thereof. This ratio is critical to the elimination of high swirl air as described herein below.

As shown in FIG. 4, the first hole 48 of each first passage 64 is spaced circumferentially along the length 42 of the segment 36 from the third hole 60 of that same first passage 64. Additionally, as shown in FIG. 3, the first hole 48 of each first passage 64 is spaced axially relative to the axis 34 from the third hole 60 of the same first passage 64. Likewise, the second hole 52 of each second passage 66 is spaced axially relative to the axis 34 from the fourth hole 62 of that same second passage 66.

Figure 5:
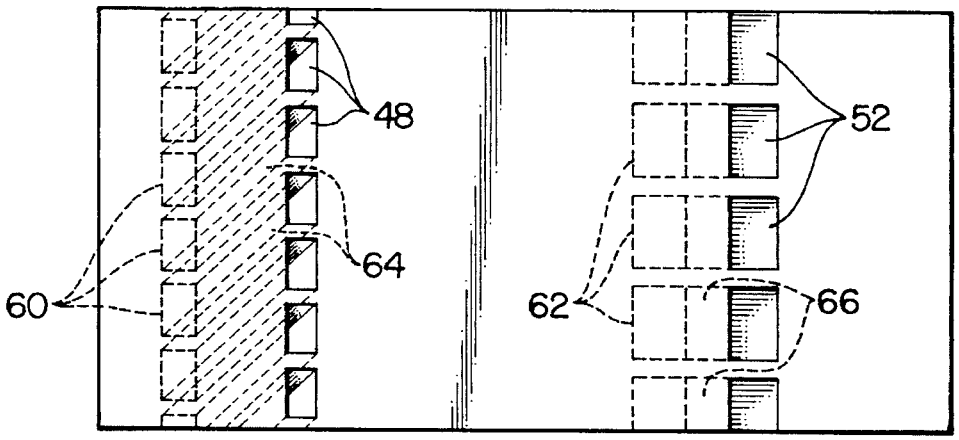
FIG. 5 is a plan view of the radially inner surface of the preferred embodiment showing alternative passages which are rectangular in cross section.

Referring again to FIG. 3, in the preferred embodiment of the present invention the plenum 56 comprises an internal cavity within the shroud 32, and each of the passages 64, 66 has a circular cross section. Alternatively, each passage 64, 66 may have a rectangular cross section as shown in FIG. 5, or such other cross section as necessitated by the particular application. Since the shroud 32 is comprised of the plurality of segments 36, each segment 36 likewise includes an internal cavity, and the sum of the internal cavities define the circumferential plenum 56 of the shroud 32.

In operation, high swirl air in the gaspath from the tips of the compressor blades passes into the second holes 52, through the second passages 66, out the fourth holes 62 in the plenum surface 58 and into the plenum 56. The air then flows through the plenum 56 to the third holes 60 in the plenum surface 58. The air then flows through the first passages 64 to the first holes 48 where it is injected back into the gaspath near the leading edge of the compressor blades 10. As is well known in the art of vaned passage case treatments of the type described in the patent referenced above, the particular angle at which the air is injected back into the gaspath is a function of the velocity of the compressor blade 10 and the velocity of the air in the gaspath. These parameters determine the respective positions of the first holes 48 relative to the third holes 60 in communication therewith to obtain the desired angle of injection. The ratio of the diameter of each first passage 64 to the length thereof eliminates most of the swirl which progressed through the plenum 56 from the fourth holes 62, so the air injected back into the gaspath has essentially no swirl component.

Figure 6:
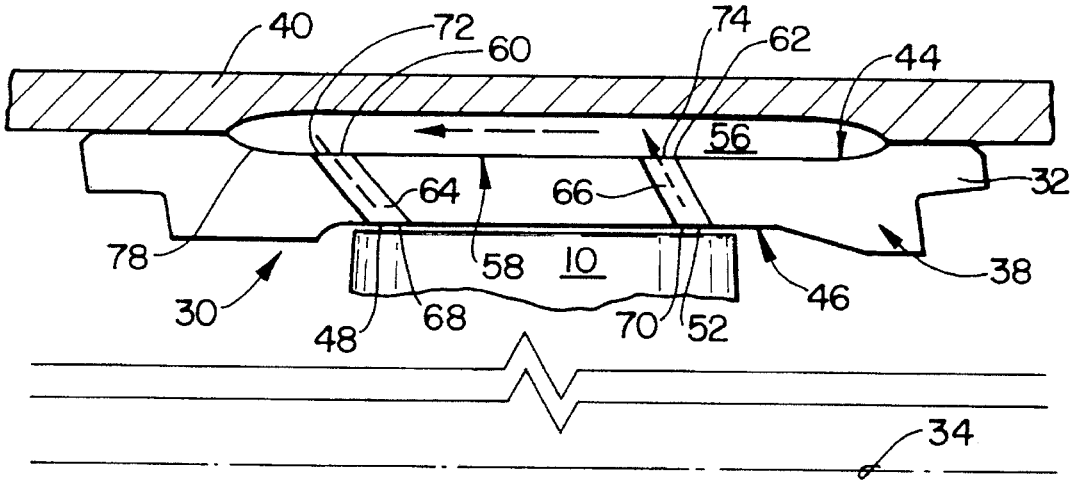
FIG. 6 is a cross sectional view of the second embodiment of the tip shroud of the present invention, showing the plenum bounded by the engine case and the segment.

The second embodiment of the present invention is shown in FIG. 6. The second embodiment the same as the preferred embodiment with respect to the passages and holes, however, in the second embodiment, the plenum 56 is not a cavity internal to the shroud 32. Instead, the plenum 56 comprises a recess 78 in the radially outer surface of each segment 36, between the segment 36 and the engine case 40. Thus, the plenum surface 58 forms a portion of the radially outer surface 44, but the plenum surface 58 is in spaced relation to the engine case 40, thus defining the plenum 56 therebetween.

Abradable material of the type known in the art may be attached to the radially inner surfaces 46 of either of the embodiments of the present invention as needed for the particular engine application. The annular shroud assembly of the present invention differs from the shrouds of the prior art in that swirl in the air passing through the plenum 56 is essentially eliminated by use of the precisely dimensioned first passages 64 as opposed to the use of complex, expensive vanes located within the plenum 56. Accordingly, the vaneless plenum 56 of the present invention substantially reduces the cost of manufacture over that of the prior art, making it economically competitive with current shrouds, while concurrently providing protection from compressor stall with efficiency penalties comparable to that of the prior art.

Although this invention has been shown and described with respect to detailed embodiments thereof, it will be understood by those skilled in the art that various changes in form and detail thereof may be made without departing from the spirit and scope of the claimed invention.

I claim:

1. A tip shroud assembly for use with an axial flow gas turbine engine case, said tip shroud assembly comprising:

an annular shroud secured to said engine case and extending circumferentially about a reference axis, said shroud including a plurality of arcuate segments, each segment having a circumferentially extending length, the sum of said lengths defining the circumference of said annular shroud, each segment comprising an arcuate member having:

a radially outer surface, and a radially inner surface including a plurality of first holes defining a first row and a plurality of second holes defining a second row, each of said rows extending circumferentially along the length of said segment, said first row in spaced relation to said second row, a circumferentially extending plenum spaced radially outward from said radially inner surface, a plurality of first passages, each first passage extending from one of said first holes to said plenum, and a plurality of second passages, each second passage extending from one of said second holes to said plenum, each of said passages having a first and a second end, wherein said plenum communicates with said radially inner surface through each of said first and second passages, a plenum surface radially outward of the radially inner surface said plenum surface including:

a plurality of third holes, each of said third holes defining the second end of one of said first passages, and a plurality of fourth holes, each of said fourth holes defining the second end of one of said second passages, each of said first holes defines the first end of one of said first passages, and the first hole of each first passage is spaced circumferentially along the length of the segment from the third hole thereof, wherein the first hole of each first passage is spaced axially relative to said axis from the third hole thereof.

2. The tip shroud assembly of claim 1 wherein each of said second holes defines the first end of one of said second passages, and the second hole of each second passage is spaced axially relative to said axis from the fourth hole thereof.

3. The tip shroud assembly of claim 2 wherein the plenum comprises an internal cavity within said shroud.

4. The tip shroud assembly of claim 2 wherein the plenum comprises a recess in the radially outer surface of each segment, and the plenum is bounded by the radially outer surface and the engine case.

* * * * *